US005441181A

United States Patent [19]

Scheindel

[11] Patent Number: 5,441,181

[45] Date of Patent: Aug. 15, 1995

[54] PISTON WITH A FLEXIBLE WIPE

[76] Inventor: Christian T. Scheindel, HCR 67 Box 45, Randolph Center, Vt. 05061

[21] Appl. No.: 287,789

[22] Filed: Aug. 9, 1994

[51] Int. Cl.[6] ..... B67D 5/54

[52] U.S. Cl. ..... 222/389; 222/386

[58] Field of Search ..... 222/386, 386.5, 387, 222/389, 1

[56] References Cited

U.S. PATENT DOCUMENTS

| | | | |
|---|---|---|---|
| 2,992,052 | 7/1961 | De John | 222/386 X |
| 3,099,370 | 7/1963 | Hein | 222/386.5 |
| 3,319,841 | 5/1967 | Berg | 222/386.5 |
| 3,381,863 | 5/1968 | Towns | 222/389 X |
| 3,901,416 | 8/1975 | Schultz | 222/389 |
| 4,106,674 | 8/1978 | Schultz | 222/389 X |
| 4,109,833 | 8/1978 | Gross | 222/386.5 |
| 4,134,523 | 1/1979 | Hansen et al. | 222/389 |
| 4,703,875 | 11/1987 | Malek | 222/389 X |
| 4,913,323 | 4/1990 | Scheindel | 222/389 X |
| 5,127,556 | 7/1992 | Sporri | 222/389 |

FOREIGN PATENT DOCUMENTS

| | | | |
|---|---|---|---|
| 0116478 | 8/1984 | European Pat. Off. | 222/389 |

*Primary Examiner*—Kevin P. Shaver

*Attorney, Agent, or Firm*—McAulay Fisher Nissen Goldberg & Kiel

[57] ABSTRACT

A piston with a flexible sealing wipe which comprises an outer annular ring which extends from a lower portion of the piston. The outer ring has an annular projecting tip which engages the sidewall of the container during upward movement of the piston within the container. The annular ring has a thickness less than the thickness of the piston sidewall to increase the flexibility of the wipe, and it is disposed adjacent to an inner annular ring and spaced therefrom by a gap. When inserted into a can, the projecting lip is displaced inwardly into the gap, with the reduced thickness of the wall assuring that the amount of resistance to piston travel is minimized. In addition, the piston provides a substantially liquid tight interference fit with the can to prevent interaction between the contents of the upper portion of the container with those in the lower portion of the container.

10 Claims, 2 Drawing Sheets

PISTON WITH A FLEXIBLE WIPE

TECHNICAL FIELD

This invention relates to pistons usable in pressure operating dispensing containers.

BACKGROUND OF THE INVENTION

Pressure operating dispensing containers which utilize a piston longitudinally slidable within the container are known in the art. These pressurized containers are used to dispense a variety of different materials of varying viscosities. The containers generally include a cylindrical can closed at one end and are provided with a dispensing nozzle having a valve for controlled discharge of a product contained therein.

The piston is received within the container and serves to separate the container into two chambers. The product to be dispensed typically occupies the upper chamber, above the piston. A pressurized fluid which acts as a propellant, occupies the lower chamber, below the piston. The piston is generally in the form of an inverted cup and has a upper surface and an annular skirt or side wall which extends down from the upper surface. The upper surface acts as a barrier wall to separate the product and propellant. The annular side wall of the piston stabilizes and positions the piston in the container and provides a surface which rides on the inner wall of the container.

The product to be dispensed is loaded into the upper chamber of the container under pressure. The loading is a three stage operation. During the first stage, known as the fill stage, the product is introduced into the can above the top of the piston. During the second stage, known as the pressure stage, a pressure differential is created above and below the piston to force some of the product down around the periphery of the piston, between the piston sidewall and the container. During the third stage, known as the pushup stage, the piston is pushed toward the top of the container. This pushup stage eliminates the air in the head space on the top of the product and also causes product to seep down around the periphery of the piston. After the loading of the product into the chambers is completed, propellant is loaded into the lower chamber under pressure. In use, when the valve at the top of the container is opened, the propellant pushes the piston toward the top of the container, forcing the product to exit the container through the nozzle.

After the container is loaded, the piston must be able to maintain a seal between the piston sidewall and the container surface. It must also minimize secondary permeation which is the diffusion of propellant around the piston at the propellant-product interface. This secondary permeation allows propellant and product to mix and thus decreases product shelf life and may otherwise adversely affect the product. Further, during the dispensing, it is important to minimize the bypass of propellant around the piston skirt into the product.

The piston skirt length is a function of container diameter. Although a piston which provides little clearance between itself and the container inner wall decreases secondary permeation, this type of fit increases bypass. As the piston diameter approaches that of the container, thereby deceasing clearance, the likelihood of secondary permeation around the piston lessens. Further, to decrease this secondary permeation, the longer the length of a tight fitting piston, the better.

However, a piston which provides little clearance over a distance also increases resistance to movement. This increased resistance to movement results in increased bypass when the container valve is first opened. Accordingly, the most effective piston is one which has a diameter capable of minimizing secondary permeation without concomitantly creating a bypass problem within the confines of the piston length necessitated by the particular can.

In U.S. Pat. No. 4,913,323, a stepped piston is described which does not deform, tilt or shift when the product is loaded into a container at high speed and which facilitates even distribution of product between the piston sidewall and the container. However, in some applications, such as when dispensing liquids and products of low viscosity, it is possible for a small portion of the liquid to pass the piston. This can be a problem, particularly when dispensing two part products where the two ingredients are separated in the can and mixed together in a particular ratio. The first part being a liquid could run past the piston so that when the second part is added the ratio would be altered and the result when discharging the product would not always be consistent, or it may result in an incomplete reaction of the ingredients.

SUMMARY OF THE INVENTION

It is an object of the present invention to provide a piston with a seal which offers little resistance to piston movement.

It is a further object to provide a piston which provides a substantially liquid tight interference fit with the container sidewall.

These and other objects of the present invention are achieved by a piston for a pressurized container comprising an upper portion shaped to conform to an inner top surface of the container to form a barrier wall to separate the container into an upper product containing chamber and a lower product containing chamber, the piston having a lower portion depending from the upper portion comprising an annular sidewall. The sidewall has a flexible sealing wipe comprising an inner annular ring and an outer annular ring, the rings extending from the annular sidewall and separated at their distal ends by a gap, the outer ring having a projecting tip for sealing and wiping the sidewall of the container during upward movement of the piston within the container. The gap allows the outer ring to flex inwardly when loaded into a container.

Utilizing the piston of the invention, an inference fit can be provided between the piston sealing wipe and container sidewall yet the gap allows displacement of the projecting tip inwardly, to avoid an excessive increase in frictional resistance during piston travel. Consequently, the invention provides a piston adaptable to pressurized containers holding liquids as the flexible wipe assures that liquids are wiped off the container sidewall while resistance to travel is minimized.

BRIEF DESCRIPTIONS OF THE DRAWINGS

Figure 3A:
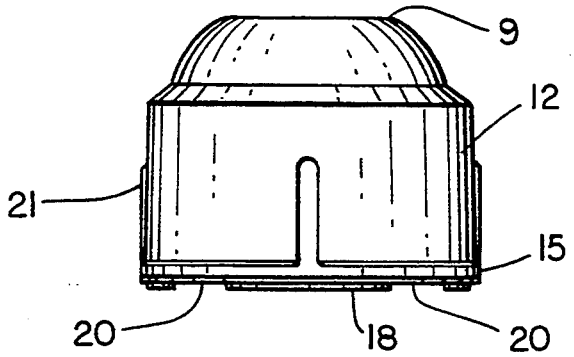
Figure 3B:
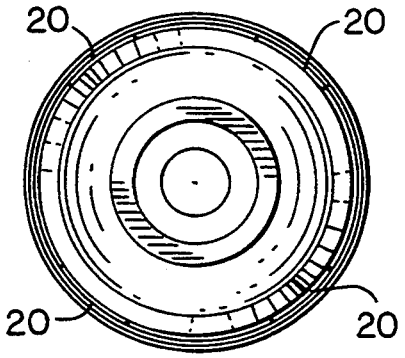

FIG. 3*a* is a side view of one embodiment of the piston of the invention, FIG. 3*b* is a bottom view of the same piston.

Figure 4:
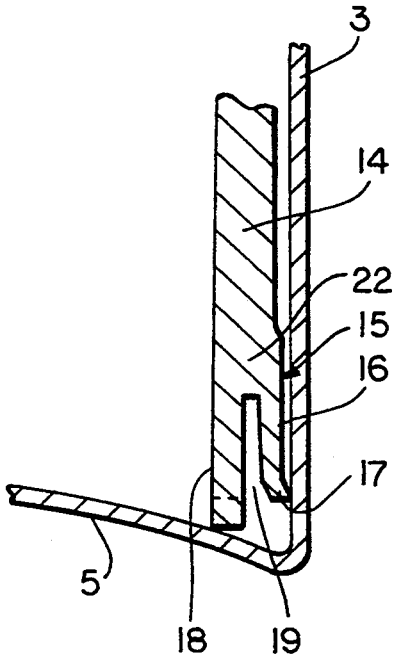

FIG. 4 is an enlarged partial cross sectional view of the piston of FIG. 3, showing the flexible wipe.

Figure 5:
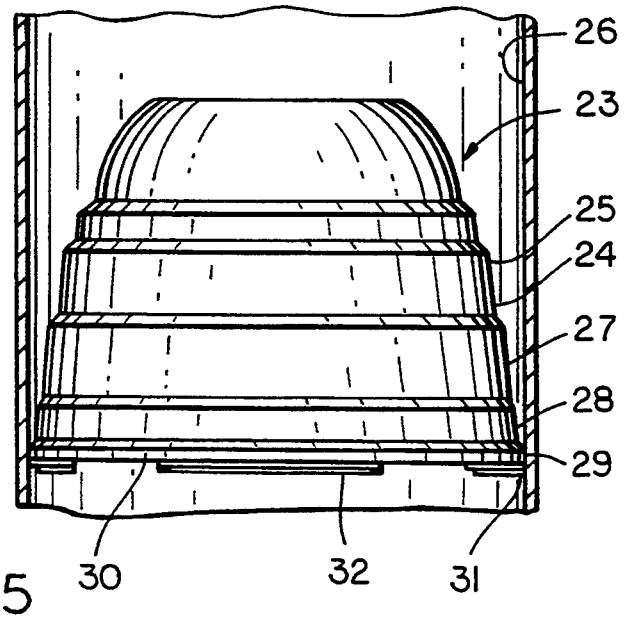

FIG. 5 is a cross sectional view of an alternative embodiment of the piston of the invention.

DETAILED DESCRIPTION OF THE INVENTION

Figure 1:
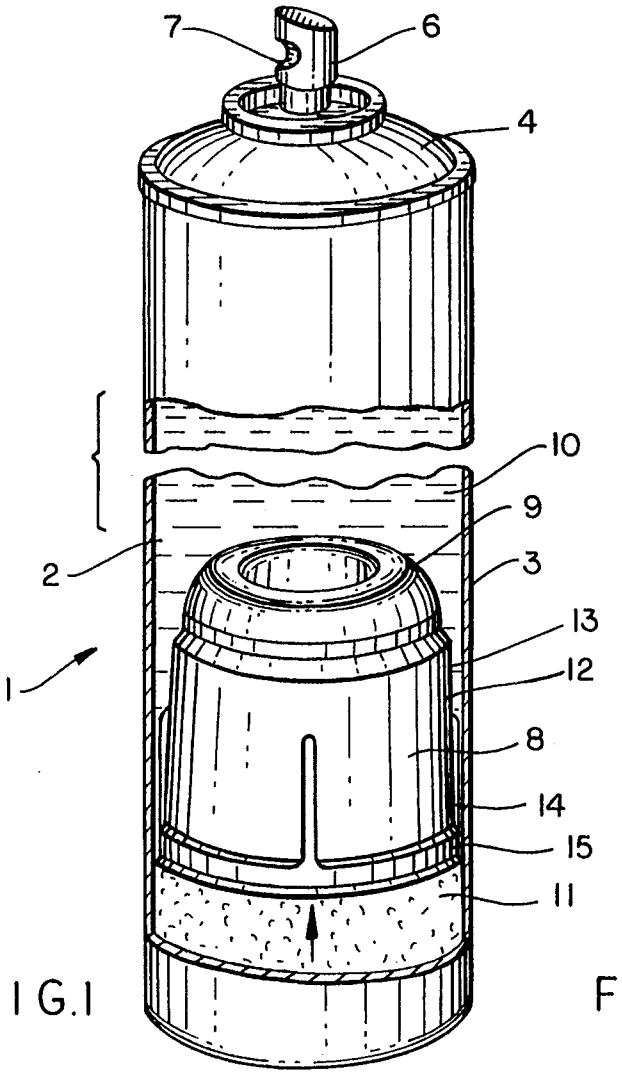
FIG. 1 is a side elevation partially broken away of a pressurized container having a flexible wiping portion in accordance with the present invention.

Referring to FIG. 1, a pressurized container 1 for dispensing a product 2 is shown. The container can be used to dispense materials of varying viscosities, but is particularly useful in dispensing low viscosity materials. The container 1 has a substantially cylindrical body 3 closed at its dispensing end by a cap 4. The body 3 is closed at the bottom by a wall 5. The container components are assembled and sealed with liquid tight integrity. A dispensing nozzle 6 is carried by the cap 4 and has valve means (not shown) which communicates with an orifice 7 which when activated, dispenses the product from the container. Such containers, dispensing nozzles and valve means are known in the art and any such components may be used with the present invention.

A piston 8 is located within the container. The piston has a top barrier wall 9 which extends substantially across the diameter of the container to separate a product chamber 10 from a propellant chamber 11. The barrier wall is generally shaped to conform to the container cap 4 to assure that all the product may be dispensed from the product chamber.

The piston 7 has an annular sidewall 12 which is connected at its upper end to the barrier wall 9. The annular wall tapers from its upper end 13 to a lower portion 14 thereof. This assists in loading the piston into the container, while minimizing the amount of product located between the annular wall and the container sidewall.

Figure 2:
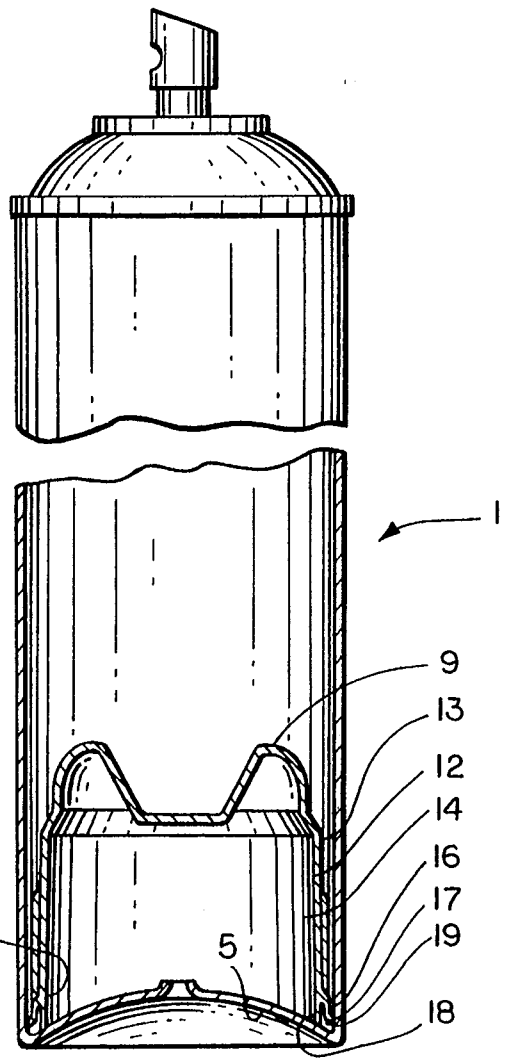
FIG. 2 is a fragmentary cross sectional view to FIG. 1.

The piston sidewall has a flexible sealing wipe 15 at a lower portion thereof, best seen in FIG. 2. The flexible wipe has an outer generally annular surface 16 and a projecting tip 17. Preferably the outer surface tapers such that the tip contacts the container wall, with an interference fit. Preferably, the interference fit ranges from about 0 to about 0.020 inch, and more preferably to about 0.010 inch.

The wall thickness of the wipe 15 is preferably less than the wall thickness of the piston sidewall 12 to increase the flexibility of the sealing wipe. Generally, the piston sidewall should be of sufficient strength to resists buckling or distortion during loading, with the wall thickness of the wipe reduced to increase flexibility. The thickness of the wipe wall may be from 20 to 70% of the piston sidewall thickness, more preferably from 30 to 60%.

The length of the sealing wipe is relatively short to minimize resistance to piston movement. The length may vary from about 0.050 to about 0.150 inch and more preferably is in the range of about 0.050 to about 0.10 inch. Of course, these ranges are illustrative, and the dimensions of the sealing wipe and piston may vary due to container size, product, propellant, pressure conditions and of course the piston material of construction.

An inner ring 18 is provided adjacent to the sealing wipe, separated therefrom by a gap 19. The gap allows for inward displacement of the wipe to assure an interference fit without increased resistance to travel. Preferably, as shown in FIGS. 2 and 3*a*, the inner ring has a longer length than the sealing ring, so that the inner ring rests on the container bottom. During product loading, the inner ring acts as a support for the piston, to prevent locking the flexible seal into a corner of the container. Additionally, the inner ring contains relief areas 20 disposed about its circumference, to allow gas to escape into the propellant area when product is squeezed into the space between the piston sidewall and can sidewall. As shown in FIG. 3*b*, four relief areas are provided.

These relief areas may vary depending on particular requirements of the container and product, etc. as described above. As shown in FIG. 3*a*, each relief area comprises about 30° of the inner ring circumference.

Referring again to FIG. 3*a*, the piston 8 includes four ribs 21 disposed about the sidewall. These ribs are optionally included, but assist in maintaining the piston upright during travel. Piston tipping could result due to variable resistance along the container sidewall which may alter seal integrity. Tipping is limited when the ribs are used as the ribs engaged the sidewalls before that would occur. The number and width of the ribs are such that they do not add significantly to the resistance to piston travel. Of course, the need for ribs would depend on the particular container, product, etc.

Referring to FIG. 4, an enlarged view of the flexible sealing wipe 15 is shown. The lower portion 14 of the piston sidewall is adjacent to a junction 22 between the inner ring 18 and the outer ring 16. The inner ring, being longer, rests on the container bottom 5. The outer ring, having a thickness of about 35% of the piston wall thickness is more flexible than the sidewall and the outwardly projecting tip 17, when engaged to the container sidewall 3, is bent inwardly into the gap 19. This provides good sealing contact as the wipe has sufficient bias to adapt to minor container imperfections. Also, the actual surface area in direct contact with the container wall is very small to avoid frictional resistance to travel.

Referring to FIG. 5, an alternative embodiment of the invention is shown. In this embodiment, a piston 23 has a stepped annular sidewall 34. The piston has an upper section 25, with a first clearance to a container sidewall 26, a middle section, with a second clearance and a third section having a third clearance 28, and additionally a flexible sealing wipe 29 as described previously in relation to FIGS. 1–4. The clearances vary in order such that the third clearance is the narrowest, the second provides an intermediate clearance and the first the largest clearance.

As shown in FIG. 5, the sealing wipe is located adjacent to the third section. The wipe has an outer surface 30, which tapers to the projecting tip 31 as described previously. An inner ring 32 is also included, again is described previously. Ribs, though not shown, may also be used with this piston. Of course, a piston having a variety of sidewall designs may benefit from the inventive sealing wipe, and the invention is not limited to those designs shown.

The inventive piston was tested with a liquid product and the container was successfully loaded and discharged the liquid without significant leakage past the projecting tip.

The piston may be produced by injection molding, thermoforming or another appropriate method. If an injected molded piston is produced, it would be understood that the piston sidewall would incorporate a degree of draft or taper to ease removal from the mold.

This taper may be accommodated by the tapered surfaces as described above.

While preferred embodiments of the present invention have been shown and described, it will be understood by those skilled in the art that various changes or modifications could be made without varying from the scope of the present invention.

I claim:

1. A piston for a pressurized container comprising an upper portion shaped to conform to an inner top surface of a container, the upper portion forming a barrier wall to separate the container into an upper product containing chamber and a lower propellant containing chamber, the piston having a lower portion depending from the upper portion, the lower portion being an annular sidewall, a sealing wipe extending downwardly from an end of the lower portion, the sealing wipe having an inner annular ring and an outer annular ring, extending downwardly from a common junction located at the end of the lower portion, the inner and outer rings being separated by a gap, the outer ring having a flexible outwardly projecting tip at a distal end thereof which extends beyond an outer diameter of the lower portion, the tip being movable inwardly into the gap when in contact with the container for wiping a sidewall of the container during upward movement of the piston within the container.

2. The piston of claim 1 wherein the inner ring has a plurality of relief areas disposed about the circumference thereof.

3. The piston of claim 1 wherein the outer ring has a substantially cylindrical outer surface, the projecting tip projecting outwardly from the distal end thereof.

4. The piston of claim 1 wherein the inner ring has a length longer than the outer ring, such that the inner ring rests on a bottom of the container.

5. The piston of claim 1 wherein the flexible outwardly projecting tip has an interference fit with the container sidewall in the range of from about 0 to about 0.020".

6. The piston of claim 1 wherein the flexible outwardly projecting tip has an interference fit with the container sidewall in the range of about 0 to about 0.010".

7. The piston of claim 1 wherein the piston lower portion has an upper section with a first clearance, a middle section with a second clearance, and a third section with a third clearance relative to the container sidewall.

8. The piston of claim 1 further comprising a plurality of ribs disposed about the circumference of the lower portion to maintain the piston in a generally upright condition.

9. The piston of claim 1 wherein the outer ring has a wall thickness of about 20% to about 70% of a lower portion wall thickness.

10. A method for maintaining a seal between a piston sidewall and a container surface comprising:

providing a piston having an upper portion shaped to conform to an inner top surface of a container, to form a barrier wall to separate the container into an upper product containing chamber and a lower propellant containing chamber, the piston having a lower portion depending from the upper portion, the lower portion being an annular sidewall, a sealing wipe extending downwardly from an end of the lower portion, the sealing wipe having an inner annular ring and an outer annular ring, extending downwardly from a common junction located at the end of the lower portion, the inner and outer rings being separated by a gap, the outer ring having a flexible outwardly projecting tip at a distal end thereof which is movable inwardly into the gap when in contact with the container surface;

placing the piston in a container having discharge means, the flexible outwardly projecting tip placed in contact with the container surface, the tip moving inwardly into the gap;

loading a product in the product containing chamber;

loading a propellant in the propellant containing chamber; and, discharging the product through the discharge means such that the flexible outwardly projecting tip travels upwardly in the container, the flexible outwardly projecting tip wiping the surface of the container during upward movement of the piston within the container.

* * * * *